US009179715B1

(12) United States Patent
Roth

(10) Patent No.: US 9,179,715 B1
(45) Date of Patent: Nov. 10, 2015

(54) BATHING SUIT TOP WITH ADJUSTABLE BACK

(71) Applicant: Heidi Roth, Hermosa Beach, CA (US)

(72) Inventor: Heidi Roth, Hermosa Beach, CA (US)

(73) Assignee: Heidi Lee Roth, Hermosa Beach, CA (US)

( * ) Notice: Subject to any disclaimer, the term of this patent is extended or adjusted under 35 U.S.C. 154(b) by 0 days.

(21) Appl. No.: 14/635,596

(22) Filed: Mar. 2, 2015

Related U.S. Application Data

(60) Provisional application No. 61/947,633, filed on Mar. 4, 2014.

(51) Int. Cl.
*A41D 7/00* (2006.01)

(52) U.S. Cl.
CPC ..... *A41D 7/00* (2013.01)

(58) Field of Classification Search
CPC ..... A41D 7/00; A41F 15/002; Y10T 24/3909
See application file for complete search history.

(56) References Cited

U.S. PATENT DOCUMENTS

| | | | | | |
|---|---|---|---|---|---|
| 550,171 | A * | 11/1895 | Hatch | 2/67 |
| 2,454,154 | A * | 11/1948 | Glick | 450/83 |
| 2,455,036 | A * | 11/1948 | Boylan | 450/86 |
| 4,612,935 | A * | 9/1986 | Greifer | 450/86 |
| 6,052,824 | A * | 4/2000 | May | 2/16 |
| 7,785,171 | B1 * | 8/2010 | Baker | 450/86 |

* cited by examiner

*Primary Examiner* — Anna Kinsaul

(57) ABSTRACT

Some embodiments of the present invention include an adjustable bathing suit top including a frontside configured to cover a wearer's chest and an adjustable backside. The backside may include a horizontal strap attached to the frontside of the bathing suit top and the horizontal strap is configured to fit around the circumference of the wearer's back. A first vertical strap and a second vertical strap are connected to the frontside of the bathing suit top, each of the first vertical strap and the second vertical strap are attached to the horizontal strap by a loop. The loops are capable of sliding along a length of the horizontal strap. A plurality of rings are wrapped around both of the vertical straps to hold the vertical straps together and the rings are capable of sliding along a length of the vertical straps.

6 Claims, 6 Drawing Sheets

BATHING SUIT TOP WITH ADJUSTABLE BACK

RELATED APPLICATION

This application claims priority to provisional patent application U.S. Ser. No. 61/947,633 filed on Mar. 4, 2014, the entire contents of which is herein incorporated by reference.

BACKGROUND

The embodiments described herein relate generally to clothing, and more particularly, to an adjustable bathing suit top.

Bathing suit tops for females come in a large variety of shapes and designs. Although many bathing suit tops are adjustable, because of various types of fasteners, such as ties, snaps, clips, hooks, or hook and loop fastener, many bathing suit tops do not provide sufficient support, especially when the bathing suit is being worn during a sporting event, such as beach volleyball. Additionally, conventional bathing suit tops are typically adjustable to, at most, two separate configurations, which do not always provide ample coverage or fit for the wearer. When females are active, by either playing beach volleyball, surfing, water skiing, and so on, conventional suits tend to provide insufficient support and limited fits and appearances Therefore, what is needed is an adjustable bathing suit top that provides ample support and sufficient coverage, while also having an improved, adjustable appearance.

SUMMARY

Some embodiments of the invention of the present invention include an adjustable bathing suit top including a frontside configured to cover a wearer's chest and an adjustable backside. The backside may include a horizontal strap attached to the frontside of the bathing suit top and configured to fit around the circumference of the wearer's back, a first vertical strap and a second vertical strap being connected to the frontside of the bathing suit top, wherein each of the first vertical strap and the second vertical strap are attached to the horizontal strap by a loop, which is capable of sliding along a length of the horizontal strap, and a plurality of rings wrapped around both of the vertical straps to hold the vertical straps together, the plurality of rings being capable of sliding along a length of the vertical straps.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one having ordinary skill in the art that the invention is not limited to the embodiments set forth and that the invention can be adapted for any of several applications.

The device of the present disclosure may be used as a bathing suit top for providing sufficient support, coverage and appearance to a wearer and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Vertical Straps
2. Horizontal Straps
3. Sliding Loops
4. Chest Piece

The various elements of the bathing suit top configured to provide suitable support and fit of the present disclosure may be related in the following exemplary fashion. It is not intended to limit the scope or nature of the relationships between the various elements and the following examples are presented as illustrative examples only.

Figure 10:
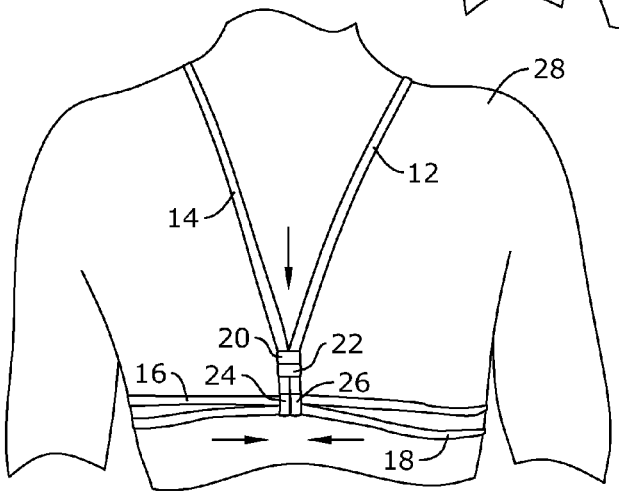
FIG. 10 is a rear view of one embodiment of the present invention, shown in use.
Figure 11:
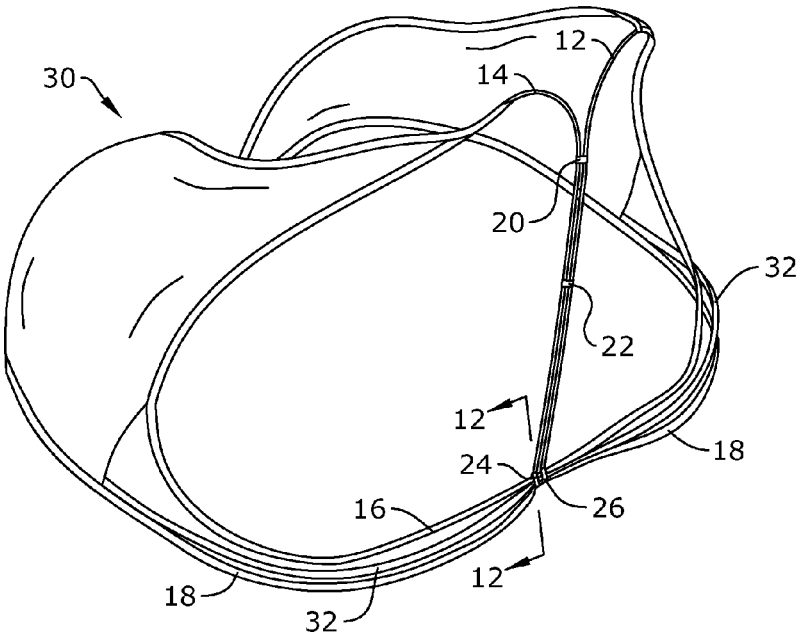
FIG. 11 is a rear perspective view of one embodiment of the present invention.
Figure 12:
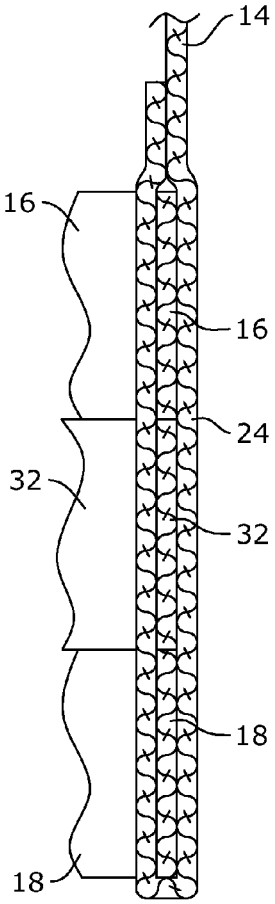
FIG. 12 is a section view of one embodiment of the present invention, taken along line 12-12 in FIG. 11.
Figure 13:
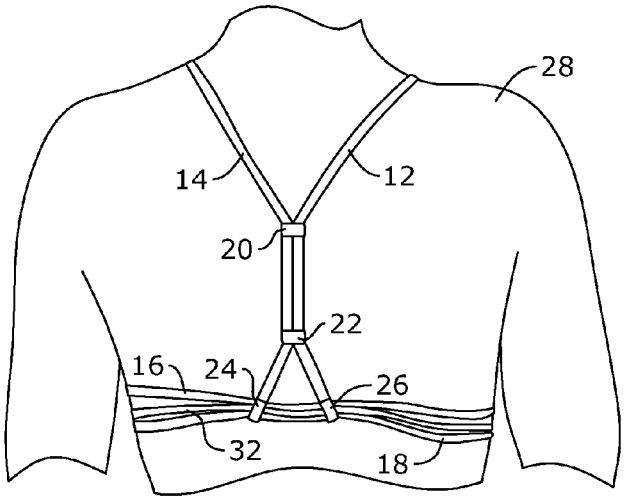
FIG. 13 is a rear view of one embodiment of the present invention, shown in use.

By way of example, and referring to FIGS. 1-13, some embodiments of the bathing suit top 10 of the present disclosure comprise a frontside configured to cover a wearer's chest and an adjustable backside. In embodiments, the backside comprises a first vertical strap 12 and a second vertical strap 14, each vertical strap 12, 14 attaching to the frontside of the bathing suit top over a shoulder of the wearer 28, wherein the first vertical strap 12 goes over the right shoulder of a wearer 28 and the second vertical strap 14 goes over the left shoulder of a wearer 28, and a horizontal strap, which wraps around the circumference of a wearer's back and attaches to a bottom portion of the frontside of the bathing suit top 10. As shown in FIGS. 2 and 6-10, the bathing suit top 10 may comprise first horizontal strap 16 and a second horizontal strap 18, wherein each of the horizontal straps 16, 18 wraps around the circumference of a wearer's back and attaches to a bottom portion of the frontside of the bathing suit top 10. In alternate embodiments, as shown in FIGS. 11-13, an alternate bathing suit top 30 may further comprise a third horizontal strap 32, which also wraps around the circumference of a wearer's back and attached to a bottom portion of the frontside of the bathing suit top 10. In yet further embodiments, the bathing suit top 10 may comprise more or less horizontal straps, as desired by the wearer 28.

As shown in FIGS. 2, 6-11, and 13, the first vertical strap 12 may comprise a first strap loop 26 and the second vertical strap 14 may comprise a second strap loop 24, wherein each of the first strap loop 26 and the second strap loop 24 may be slidably attached around the horizontal strap, allowing positioning of the first vertical strap 12 and the second vertical strap 14 to be adjustable along the length of the horizontal strap. In other words, the strap loops 26, 24 may allow the vertical straps 12, 14 to slide along the length of the horizontal strap to position the vertical straps 12, 14 in their desired configurations. For example, as shown in FIGS. 2, 6, 10, and 11, the first strap loop 26 and the second strap loop 24 may be positioned adjacent to each other. Alternatively, as shown in FIGS. 7-9 and 13, the first strap loop 26 and the second strap loop 24 may be positioned at varying distances from each other, giving the backside of the bathing suit top 10 a different fit and appearance. The strap loops 26, 24 may be separated from each other by any distance desired by the user to achieve the desired look and fit.

Figure 7:
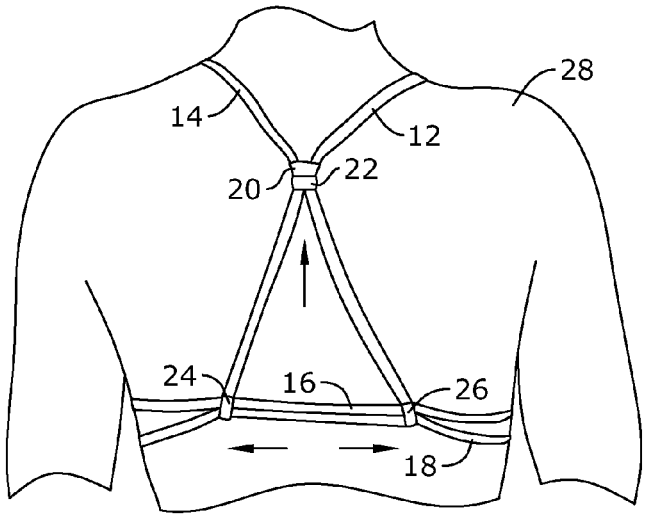
FIG. 7 is a rear view of one embodiment of the present invention, shown in use.
Figure 8:
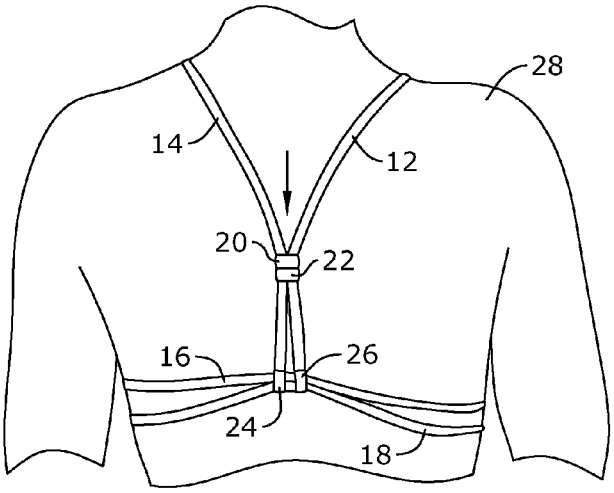
FIG. 8 is a rear view of one embodiment of the present invention, shown in use.
Figure 9:
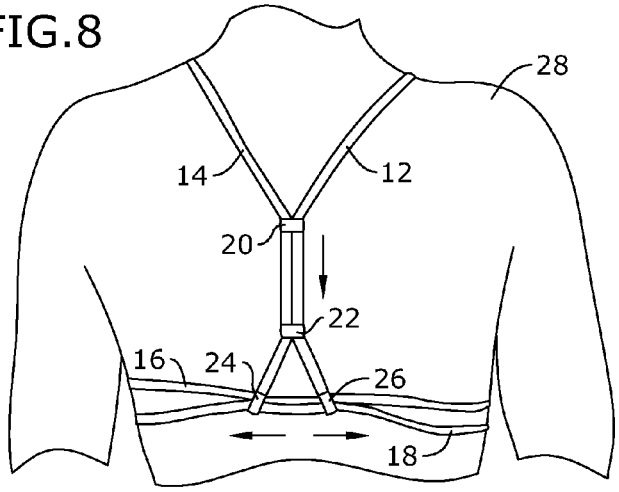
FIG. 9 is a rear view of one embodiment of the present invention, shown in use.

Embodiments of the bathing suit top 10 may also comprise at least one ring wrapped around both of the vertical straps 12, 14. For example, the bating suit top 10 may comprise an upper ring 20 and a lower ring 22 wrapped around the vertical straps 12, 14, wherein the rings 20, 22 may be configured to aid in the adjustment of the appearance and fit of the bathing suit top 10 by being configured to slide up and down the length of the vertical straps 12, 14. For example, as shown in FIGS. 1, 2, 6, 9, 11, and 13, the rings 20, 22 may be spaced apart along the vertical straps 12, 14 resulting in at least a portion of the vertical straps 12, 14 being parallel to each other. Alternatively, as shown in FIGS. 7, 8, and 10, the rings 20, 22 may be positioned adjacent to each other on the vertical straps 12, 14 to adjust the fit and appearance of the bathing suit top 10 such that the vertical straps 12, 14 are positioned in a desired configuration.

Figure 1:
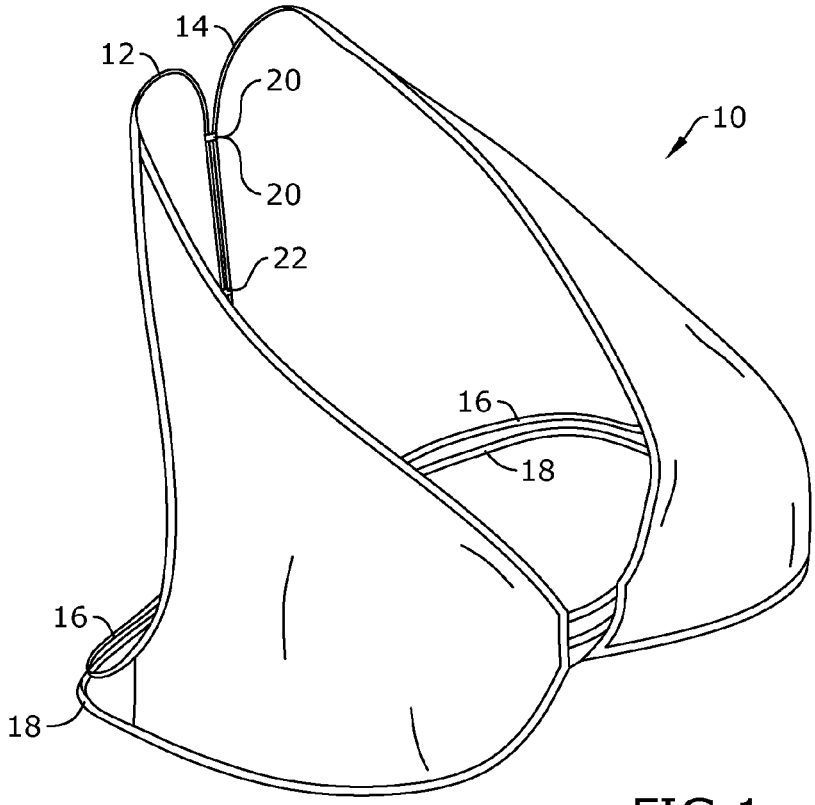
FIG. 1 is a front perspective view of one embodiment of the present invention.
Figure 2:
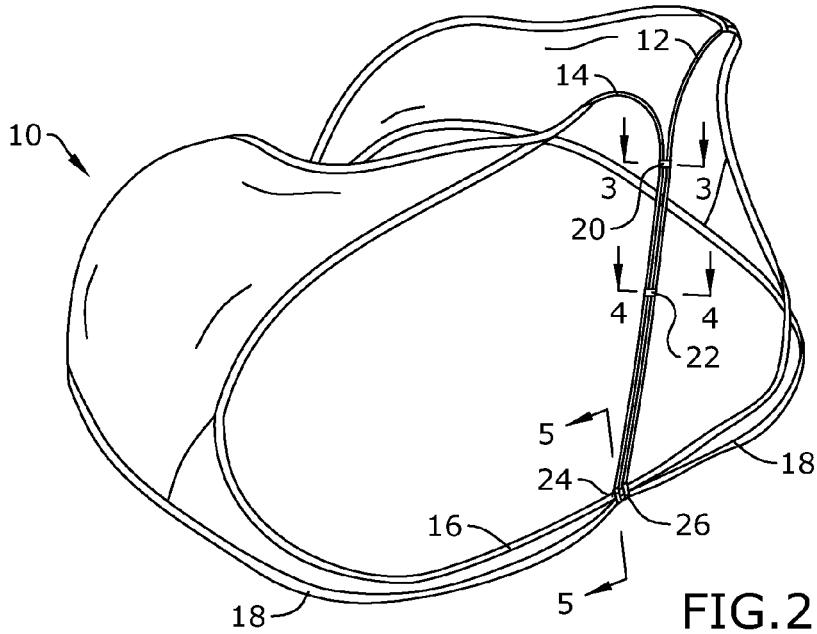
FIG. 2 is a rear perspective view of one embodiment of the present invention.
Figure 3:
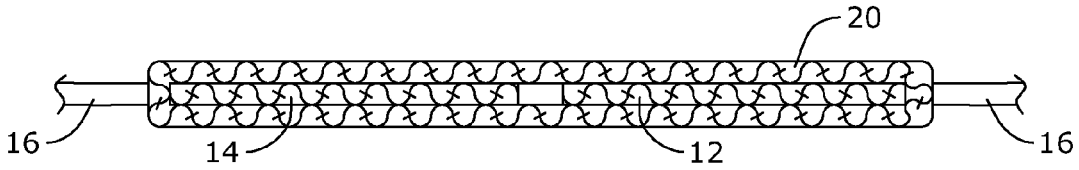
FIG. 3 is a section view of one embodiment of the present invention, taken along line 3-3 in FIG. 2.
Figure 4:
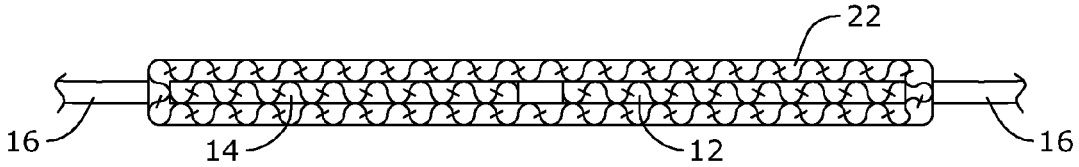
FIG. 4 is a section view of one embodiment of the present invention, taken along line 4-4 in FIG. 2.
Figure 5:
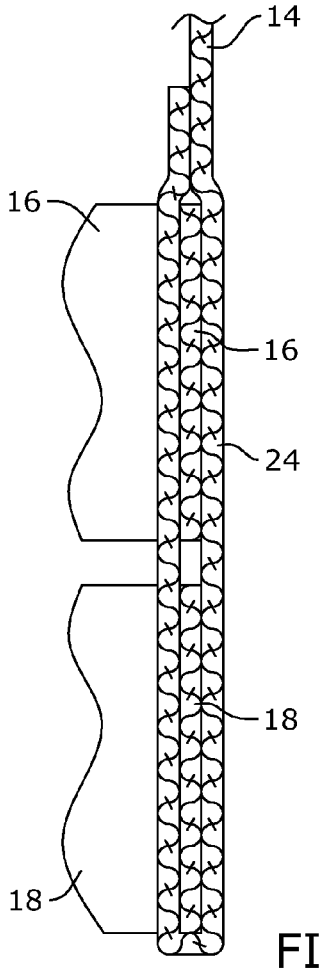
FIG. 5 is a section view of one embodiment of the present invention, taken along line 5-5 in FIG. 2.
Figure 6:
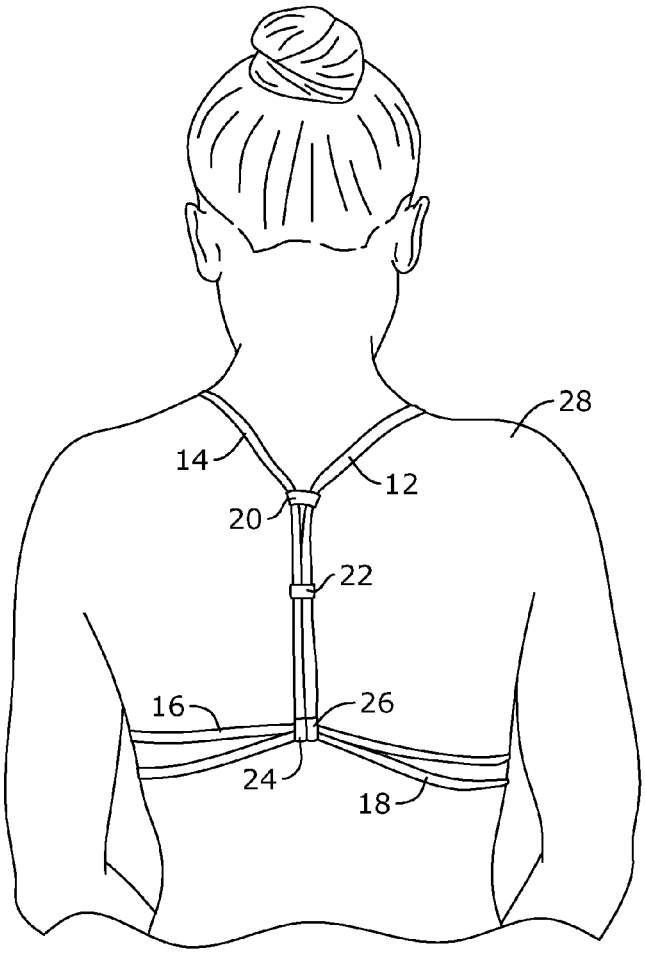
FIG. 6 is a rear view of one embodiment of the present invention, shown in use.

The shape and design of the frontside of the bathing suit top 10 is not particularly limited, so long as the frontside is configured to attach to the first vertical strap 12 and second vertical strap 14 over each shoulder of the wearer 28. In some embodiments, the frontside comprises a left chest piece and a right chest piece, which are substantially triangular in shape, as shown in FIG. 1.

Figure 14:
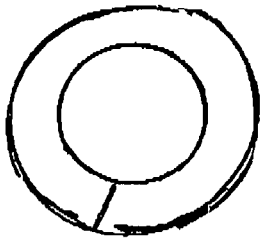
FIG. 14 is an example of a strap cross section that is round.

The bathing suit top 10 of the present disclosure may be made of any suitable or conventional fabric used for bathing suits. For example, the straps 12, 14, 16, 18, 32, loops 24, 26 and rings 20, 22 may comprise an elastic material. Additionally, the loops 24, 26 may comprise other materials or fasteners, such as ties, that may be configured to slide about the horizontal straps 16, 18, 32. Alternatively, in some embodiments, the rings 20, 22 may be made of hardware rings. In some embodiments, the straps 12, 14, 16, 18, 32 are manufactured in such a way that they have a round cross section (FIG. 14), while in other embodiments, the straps 12, 14, 16, 18, 32 are flat (FIGS. 3-5 and 12). Embodiments of the bathing suit top 10 comprising flat straps may be less likely to roll and more likely to stay in place on a wearer 28 as compared to embodiment having round straps.

As a result of the design of the bathing suit top 10 of the present disclosure, a wearer 28 may have an adjustable bathing suit top 10 that does not include any conventional fasteners, such as clips, buckles, snaps, hook and loop fastener, hooks, or ties. The backside of the bathing suit top 10 may be adjusted by sliding the rings 20, 22 into different positioned along the length of the vertical straps 12, 14 and by sliding the loops 24, 26 into different positions along the length of the horizontal strap. Depending on the desired support and fit, the user 28 may adjust the straps as necessary, which may increase or decrease support or coverage depending on the configuration of the straps. Additionally, because the straps are adjustable into a variety of configurations, such as the exemplary configurations shown in the Figures, a wearer 28 may avoid getting tan lines, as the straps are not required to always be in the same position. Moreover, the bathing suit top 10 of the present disclosure, because of its design, may fit securely even when a wearer 28 is being active, such as when playing beach volleyball or other sports. The design of the bathing suit top 10 allows for multiple different appearances, such as at least 5 different appearances created by changing the configuration of the straps.

While the invention of the present disclosure is described as being a bathing suit top, the invention may be used as any other article of clothing designed to cover and support the chest of wearer. For example, it caused a bra or crop top.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A bathing suit top for providing an adjustable appearance and fit, the bathing suit top comprising:

a frontside configured to cover a wearer's chest; and an adjustable backside comprising:

a first, second, and third horizontal strap, each of the horizontal straps attached to a bottom portion of the frontside of the bathing suit top and configured to be wrapped around the circumference of a wearer's back;

a first vertical strap and a second vertical strap, each of the first and second vertical straps being connected to the frontside of the bathing suit top, such that when the bathing suit top is being worn, the first vertical strap fits over a wearer's first shoulder and the second vertical strap fits over a wearer's second shoulder, wherein the first vertical strap is attached to the first, second, and third horizontal straps by a first strap loop and the second vertical strap is attached to the first, second, and third horizontal straps by a second strap loop, wherein each of the first strap loop and the second strap loop is configured to slide along a length of the first, second, and third horizontal straps; and a plurality of rings, each of the plurality of rings wrapped around both of the vertical straps, the plurality of rings being capable of sliding along a length of the vertical straps.

2. The bathing suit top of claim 1, wherein the plurality of rings comprise an upper ring and a lower ring wrapped around both of the vertical straps.

3. The bathing suit too of claim 1, wherein each of the plurality of rings comprises a ring made of a member selected from the group consisting of an elastic material and/or a piece of hardware.

4. The bathing suit top of claim 1, wherein each of the horizontal straps, the first vertical strap, and the second vertical strap each have a rounded cross section.

5. The bathing suit top of claim 1, wherein each of the horizontal straps, the first vertical strap, and the second vertical strap each have a flattened cross section.

6. A bathing suit top for providing an adjustable appearance and fit, the bathing suit top comprising:

a frontside configured to cover a wearer's chest; and an adjustable backside comprising:

a first, second, and third horizontal strap, each of the horizontal straps attached to a bottom portion of the frontside of the bathing suit top and configured to be wrapped around the circumference of a wearer's back;

a first vertical strap and a second vertical strap, each of the first and second vertical straps being connected to the frontside of the bathing suit top, such that when the bathing suit top is being worn, the first vertical strap fits over a wearer's first shoulder and the second vertical strap fits over a wearer's second shoulder, wherein the first vertical strap is attached to the first, second, and third horizontal straps by a first strap loop and the second vertical strap is attached to the first, second, and third horizontal straps by a second strap loop, wherein each of the first strap loop and the second strap loop is configured to slide along a length of the first, second, and third horizontal straps; and an upper ring and a lower ring, each of the upper ring and lower ring wrapped around both of the vertical straps, each of the rings being slidable along a length of the vertical straps.

* * * * *